US010562203B2

(12) United States Patent
Jacko

(10) Patent No.: US 10,562,203 B2
(45) Date of Patent: Feb. 18, 2020

(54) KNIFE ASSEMBLY FOR SLICING MACHINES AND MACHINES EQUIPPED THEREWITH

(71) Applicant: URSCHEL LABORATORIES, INC., Chesterton, IN (US)

(72) Inventor: Michael Scot Jacko, Valparaiso, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 169 days.

(21) Appl. No.: 15/807,145

(22) Filed: Nov. 8, 2017

(65) Prior Publication Data

US 2018/0126581 A1 May 10, 2018

Related U.S. Application Data

(60) Provisional application No. 62/418,945, filed on Nov. 8, 2016.

(51) Int. Cl.
*B26D 7/26* (2006.01)
*B26D 7/06* (2006.01)

(52) U.S. Cl.
CPC ..... *B26D 7/2614* (2013.01); *B26D 7/0691* (2013.01); *B26D 2210/02* (2013.01)

(58) Field of Classification Search
CPC ..... B26D 2210/02; B26D 7/0691; B26D 7/2614; Y10T 83/9457
See application file for complete search history.

(56) References Cited

U.S. PATENT DOCUMENTS 1,601,335 A * 9/1926 Addison ..... B26D 7/20 144/230
3,139,127 A 6/1964 Urschel et al.
3,139,128 A 6/1964 Urschel et al.
3,139,129 A 6/1964 Urschel et al.
3,139,130 A 6/1964 Urschel et al.
3,742,565 A 7/1973 Boboltz et al.
5,035,165 A * 7/1991 Madsen ..... B26D 7/2614 493/366

(Continued)

FOREIGN PATENT DOCUMENTS

WO 2014165572 10/2014

OTHER PUBLICATIONS

PCT International Search Report and Written Opinion dated Feb. 14, 2018; PCT/US17/60633 filed Nov. 8, 2017.

*Primary Examiner* — Stephen Choi
(74) *Attorney, Agent, or Firm* — Hartman Global IP Law; Gary M. Hartman; Domenica N. S. Hartman

(57) ABSTRACT

A slicing machine having a cutting head and a knife assembly mounted thereto, and methods for clamping a knife of the knife assembly in the slicing machine. The knife assembly includes a knife holder having a support surface that supports the knife and a clamp overlying the knife holder so that the knife is between the support surface of the knife holder and the clamp. A clamping rod is rotated from a release position to a clamping position to secure the clamp to the knife holder and clamp the knife therebetween. The clamping rod is eccentrically mounted to the cutting head and uses eccentricity to apply a clamping load to the clamp when rotated from the release position to the clamping position.

12 Claims, 8 Drawing Sheets

(56) References Cited

U.S. PATENT DOCUMENTS

| | | | | |
|---|---|---|---|---|
| 5,694,824 | A | 12/1997 | Jacko et al. | |
| 5,819,628 | A * | 10/1998 | Cogan | B23D 35/008 83/698.11 |
| 6,968,765 | B2 | 11/2005 | King | |
| 8,161,856 | B2 * | 4/2012 | Jacko | B26D 1/03 83/403 |
| 2006/0219080 | A1 | 10/2006 | Heid | |
| 2007/0272067 | A1 * | 11/2007 | Chen | B23D 51/10 83/651 |
| 2014/0007751 | A1 | 1/2014 | Michel et al. | |
| 2016/0075047 | A1 | 3/2016 | Fam | |

* cited by examiner

KNIFE ASSEMBLY FOR SLICING MACHINES AND MACHINES EQUIPPED THEREWITH

This application claims the benefit of U.S. Provisional Application No. 62/418,945, filed Nov. 8, 2016, the contents of which are incorporated herein by reference.

BACKGROUND OF THE INVENTION

The present invention generally relates to machines for cutting products, including but not limited to slicing food products. The invention particularly relates to a knife assembly for securing a knife to a slicing machine.

Various types of equipment are known for slicing, shredding and granulating food products, as nonlimiting examples, vegetables, fruits, dairy products, and meat products. Widely used machines for this purpose are commercially available from Urschel Laboratories, Inc., and include machines under the names Model CC® and Model CCL. The Model CC® and CCL machines are centrifugal-type slicers capable of slicing a wide variety of products at high production capacities. The Model CC® line of machines is particularly adapted to produce uniform slices, strip cuts, shreds and granulations, and the Model CCL line is particularly adapted to produce slices or chips of a waffle or lattice type. Certain configurations and aspects of Model CC® machines are represented in U.S. Pat. Nos. 3,139,128, 3,139,129, 5,694,824 and 6,968,765, the entire contents of which are incorporated herein by reference. Certain configurations and aspects of Model CCL machines are represented in U.S. Pat. Nos. 3,139,127 and 3,139,130, the entire contents of which are incorporated herein by reference.

FIG. 1 schematically depicts a machine 10 representative of a Model CC® machine. The machine 10 includes a generally annular-shaped cutting head 12 equipped with cutting knives (not shown) mounted at its inner circumference. An impeller 14 is coaxially mounted within the cutting head 12 and has an axis 17 of rotation that coincides with an axis of the cutting head 12. The impeller 14 is rotationally driven about its axis 17 through a shaft that is enclosed within a housing 18 and coupled to a gear box 16. The cutting head 12 is mounted on a support ring 15 above the gear box 16 and remains stationary as the impeller 14 rotates. Products are delivered to the cutting head 12 and impeller 14 through a feed hopper 11 located above the impeller 14. In operation, as the hopper 11 delivers products to the impeller 14, centrifugal forces cause the products to move outward into engagement with the knives of the cutting head 12. The impeller 14 comprises generally radially-oriented paddles 13, each having a face that engages and directs the products radially outward toward and against the knives of the cutting head 12 as the impeller 14 rotates. Other aspects pertaining to the construction and operation of Model CC® machines, including improved embodiments thereof, can be appreciated from U.S. Pat. Nos. 3,139,128, 3,139,129, 5,694,824 and 6,968,765.

FIG. 2 is an isolated view of the cutting head 12 of FIG. 1, and FIG. 3 is a fragmentary bottom view of the cutting head 12. The cutting head 12 is generally annular-shaped with cutting knives 20 mounted on its perimeter. Each knife 20 projects radially inward in a direction generally opposite the direction of rotation of the impeller 14, and defines a cutting edge at its radially innermost extremity. The cutting head 12 is shown in FIG. 2 as further comprising a lower support ring 22, an upper support ring 24, and circumferentially-spaced support segments, referred to herein as shoes

26. The knives 20 of the cutting head 12 are individually secured to the shoes 26 with knife assemblies 28. Each knife assembly 28 includes a knife holder 28A mounted to the radially inward-facing side of a shoe 26, and a clamp 28B mounted on the radially outward-facing side of a shoe 26 to secure a knife 20 to the knife holder 28A. The shoes 26 are represented as secured with bolts 30 to the support rings 22 and 24. The shoes 26 are equipped with coaxial pivot pins (not shown) that engage holes in the support rings 22 and 24. By pivoting on its pins, the orientation of a shoe 26 can be adjusted to alter the radial location of the cutting edge of its knife 20 with respect to the axis of the cutting head 12, thereby controlling the thickness of the sliced food product. As an example, adjustment can be achieved with an adjusting screw and/or pin 32 located circumferentially behind the pivot pins. FIG. 2 further shows optional gate insert strips 34 mounted to each shoe 26, which the food product crosses prior to encountering the knife 20 mounted to the succeeding shoe 26.

FIGS. 2 and 3 show the knives 20 and clamps 28B secured to their respective knife holders 28A with bolts 36. Alignment of the knife 20 and clamp 28B of each assembly 28 is achieved with pins 38 (FIG. 3) that protrude from the support surface of the knife holder 26B. As better understood through the detail view of FIG. 4, the opposing surfaces of the knife holder 28A and clamp 28B result in the clamp 28B applying a force to the knife 20 adjacent its cutting edge.

FIGS. 5 and 6 depict a quick-clamping knife assembly 40 disclosed in U.S. Pat. Nos. 7,658,133 and 8,161,856 that can be used in lieu of the bolts 36 shown in FIGS. 2 and 3. The knife assembly 40 comprises a knife holder 40A and clamp 40B, the latter of which may be similar if not identical to the clamp 28B of FIGS. 2 and 3. The knife holder 40A includes an optional insert 42 that supports the knife 20 near its cutting edge and serves to protect the edge of the knife holder 40A from stones or other debris that often accompany food products that undergo slicing. The knife holder 40A and clamp 40B are loosely assembled together with a bolt 44 that is installed in the knife holder 40A, passes through the clamp 40B, and is threaded into a clamping bar 46. An eccentric clamping rod 48 is disposed within a recess 50 formed in a surface of the knife holder 40A, and has a flat 52 defined on its otherwise cylindrical peripheral surface. The clamping rod 48 is situated between and contacts the knife holder 40A and a proximal end of the clamp 40B opposite the knife 20. The rod 48 can be rotated within the recess 50 between clamping and release positions, which serve to secure and release, respectively, the knife 20. The clamping position is depicted in FIG. 6 and results from the proximal end of the clamp 40B being engaged by the cylindrical surface of the rod 48, which forces the proximal end outward away from the knife holder 40A and, with the clamping bar 46 serving as a fulcrum, forces the oppositely-disposed distal end of the clamp 40B into engagement with the knife 20. The force applied to the clamp 40B by the rod 48 can be released by rotating the rod 48 so that its flat 52 faces the proximal end of the clamp 40B.

While centrifugal-type slicers of the type represented by the Model CC® have performed extremely well for their intended purpose, further improvements are continuously desired and sought for centrifugal-type slicing machines.

BRIEF DESCRIPTION OF THE INVENTION

The present invention provides a centrifugal-type slicing machine having a cutting head and a knife assembly mounted thereto, and means for clamping and releasing a knife of the knife assembly.

According to one aspect, the knife assembly includes a knife holder having a support surface terminating at a distal edge, a knife supported by the support surface of the knife holder such that a cutting edge of the knife projects beyond the distal edge of the knife holder, and a clamp overlying the knife holder so that the knife is between the support surface of the knife holder and the clamp. The clamp has an inward surface facing the knife holder and an outward surface facing away from the knife holder. A clamping rod secures the clamp to the knife holder and clamps the knife therebetween. The clamping rod has a camming surface that contacts the outward surface of the clamp. The clamping rod is rotatable to have a clamping position and a release position, wherein the camming surface applies a force that clamps the clamp against the knife holder when the clamping rod is in the clamping position, and the camming surface releases the force against the clamp when the clamping rod is in the release position.

According to another aspect, a method is provided for clamping a knife of a knife assembly in a slicing machine that comprises a cutting head to which the knife assembly is mounted. The knife assembly comprises a knife holder having a support surface that supports the knife and a clamp overlying the knife holder so that the knife is between the support surface of the knife holder and the clamp. The method includes rotating a clamping rod from a release position to a clamping position to secure the clamp to the knife holder and clamp the knife therebetween. The clamping rod is eccentrically mounted to the cutting head and uses eccentricity to apply a clamping load to the clamp when rotated from the release position to the clamping position.

Technical aspects of the knife assembly described above preferably include the ability of the clamping rod to quickly and reliably clamp and release the knife by simply rotating the rod and using a clamping assembly having relatively few components.

Other aspects and advantages of this invention will be better appreciated from the following detailed description.

DETAILED DESCRIPTION OF THE INVENTION

Figure 1:
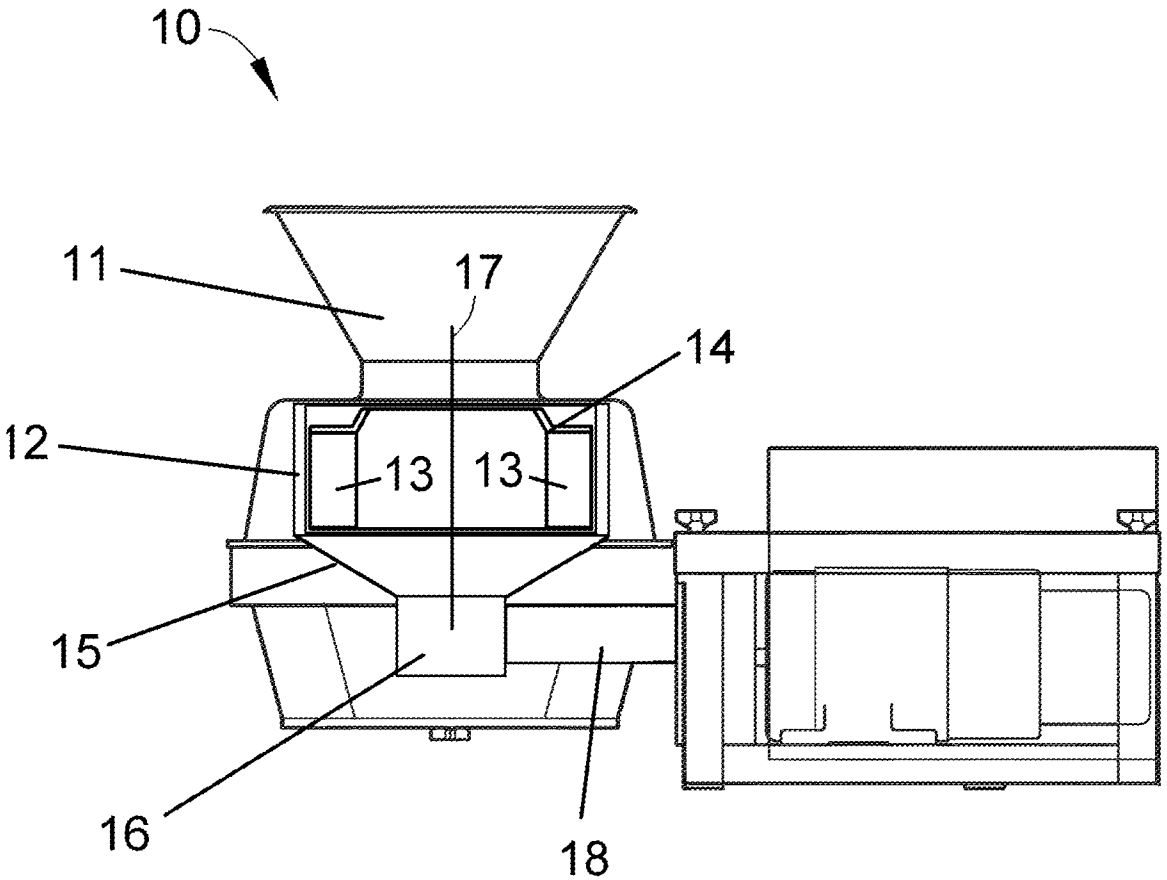
FIG. 1 PRIOR ART
FIG. 1 schematically represents a side view in partial cross-section of a slicing machine known in the art.

FIGS. 7 through 10 contain various views of a knife assembly 60 and components thereof that are capable of use with a variety of cutting machines, including the centrifugal-type slicing machine 10 depicted in FIG. 1, and in some instances may be a modification or retrofit for such a machine. A nonlimiting embodiment of the invention will be illustrated and described hereinafter in reference to the slicing machine 10 of FIG. 1 equipped with an impeller 14 and annular-shaped cutting head 12 as described in reference to FIGS. 1 and 2, and as such the following discussion will focus primarily on certain aspects of the invention that will be described in reference to the slicing machine 10 and cutting head 12 of FIGS. 1 and 2, whereas other aspects not discussed in any detail below may be, in terms of structure, function, materials, etc., essentially as was described in reference to FIGS. 1 through 6. However, it will be appreciated that the teachings of the invention are more generally applicable to other types of cutting machines.

Figure 2:
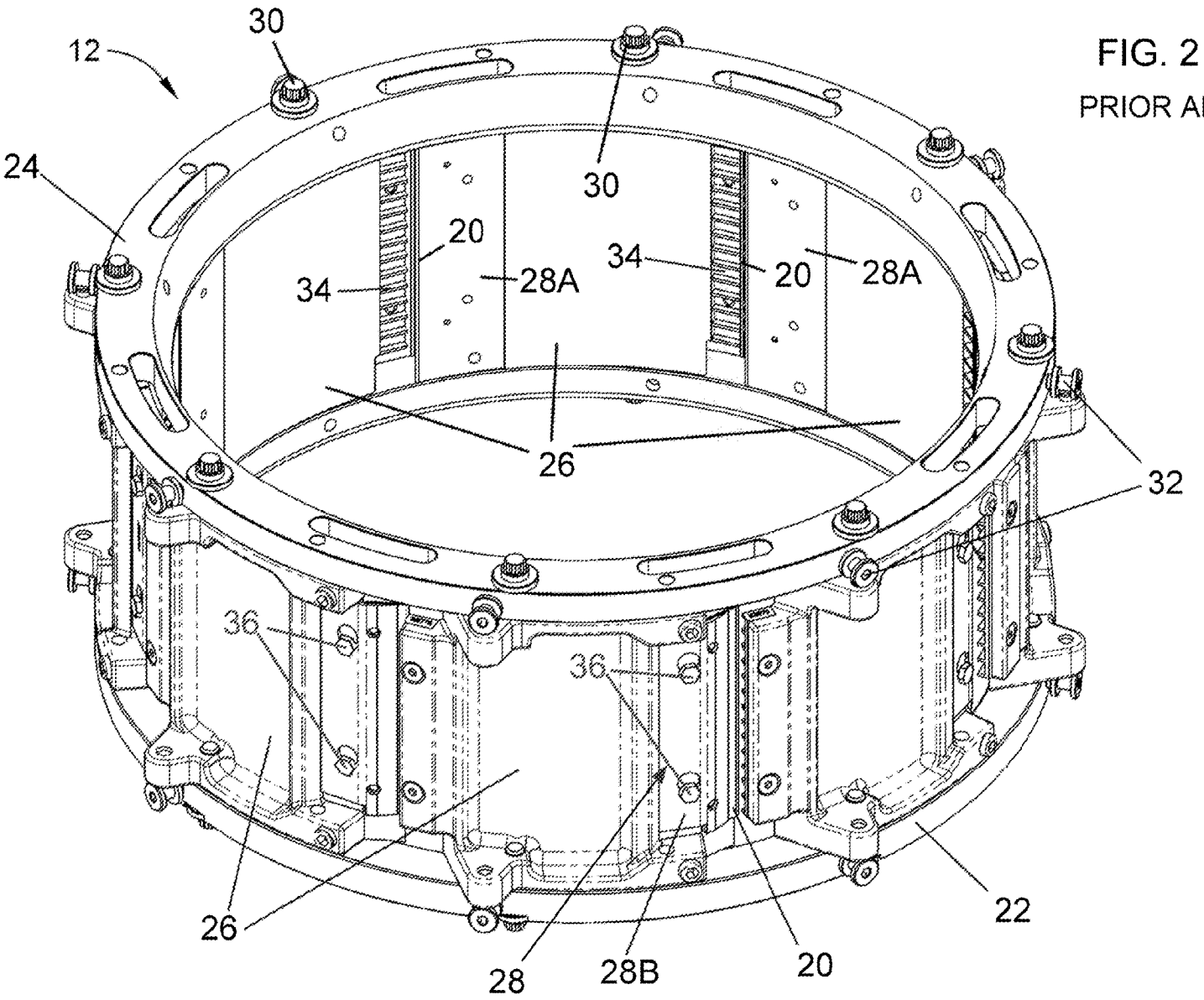
FIG. 2 PRIOR ART
FIG. 2 is a perspective view representing details of a cutting head of a type suitable for use in the slicing machine of FIG. 1.
Figure 3:
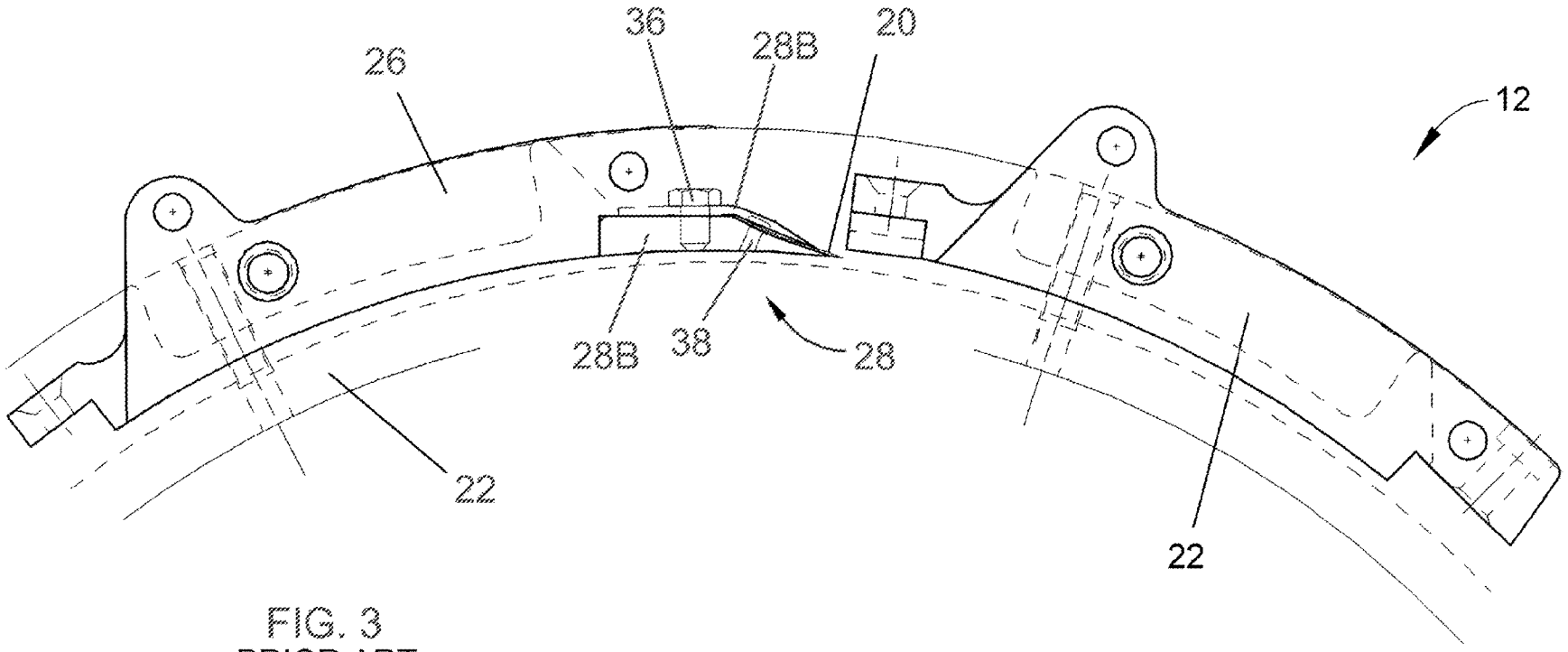
FIG. 3 PRIOR ART
FIG. 3 is a bottom view showing a fragment of the cutting head of FIG. 2.
Figure 4:
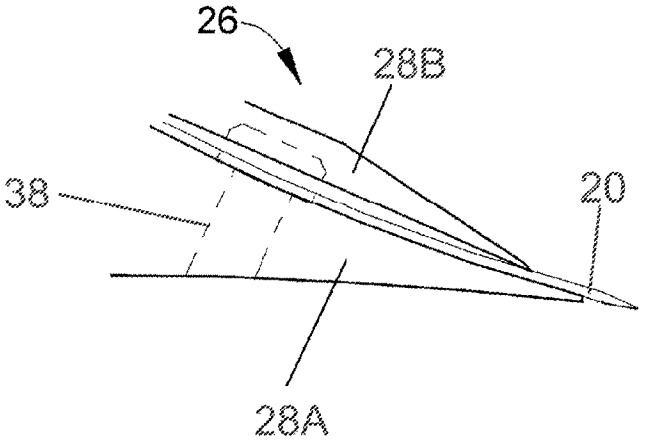
FIG. 4 PRIOR ART
FIG. 4 is a detailed view of a portion of a knife assembly of the cutting head.
Figure 5:
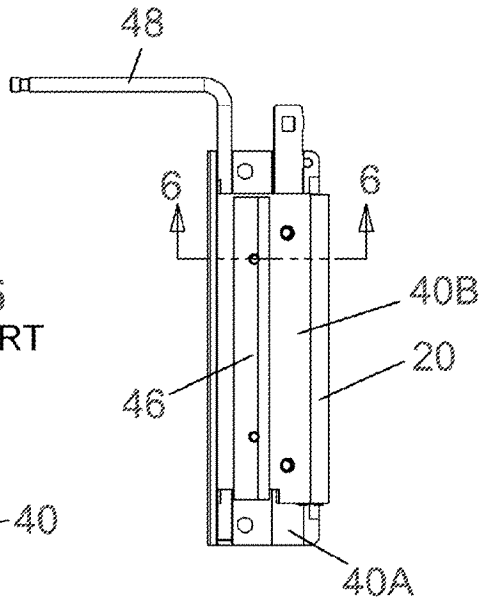
FIG. 5 PRIOR ART
FIGS. 5 and 6 are side and cross-sectional views, respectively, of an alternative knife assembly capable of use with the cutting head of FIG. 2.
Figure 6:
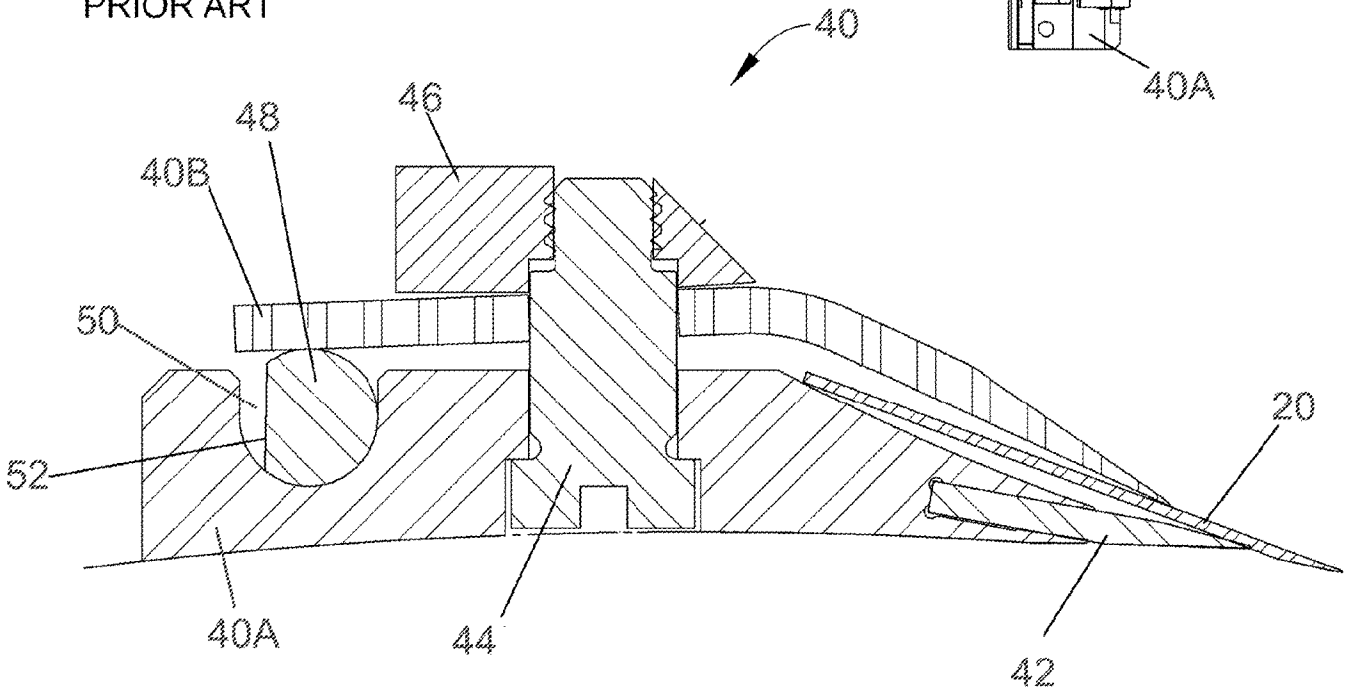
FIG. 6 PRIOR ART
Figure 7:
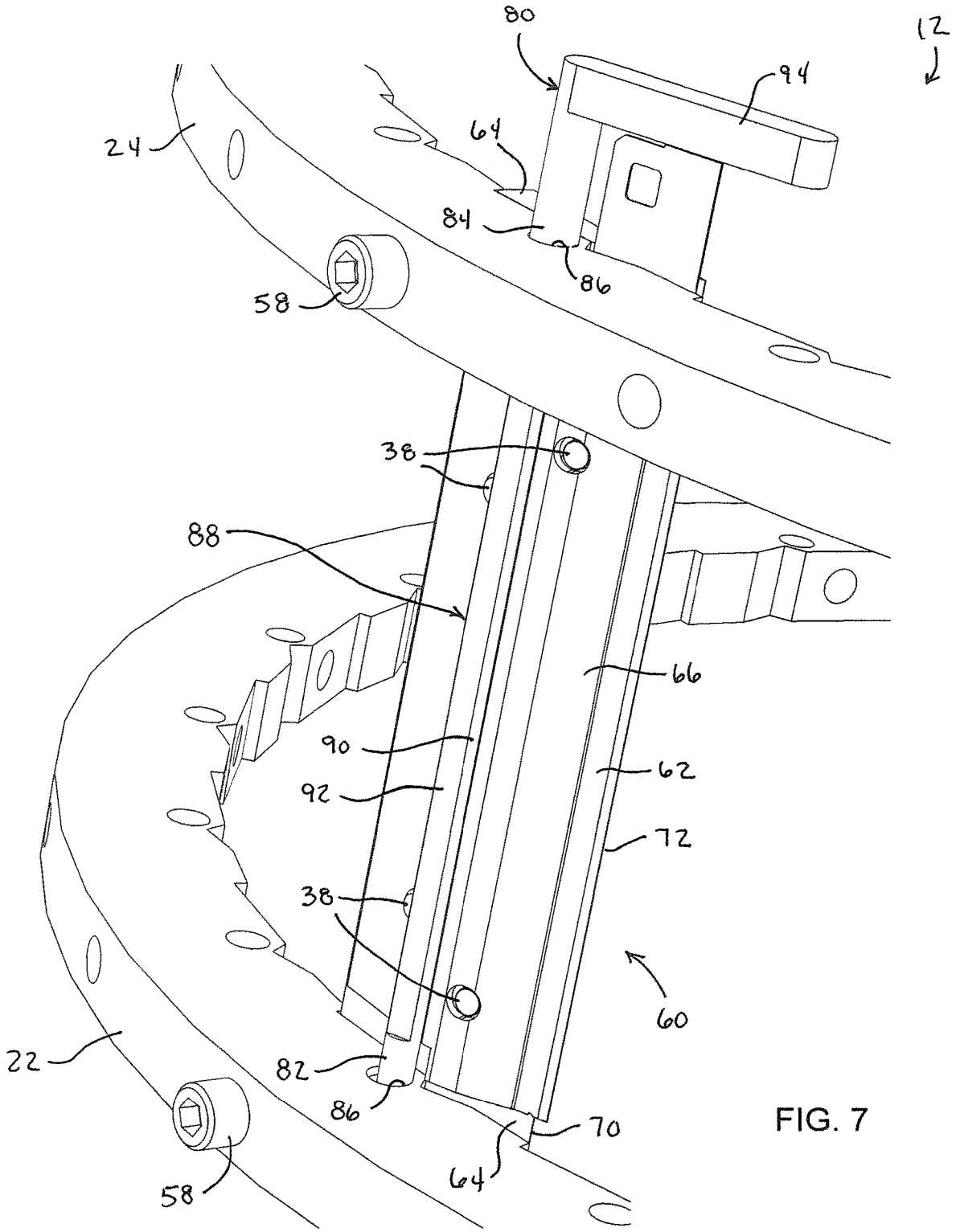
FIG. 7 is a perspective view of a knife assembly installed on a cutting head in accordance with a nonlimiting embodiment of the invention.

To facilitate the description provided below of the embodiment represented in the drawings, relative terms, including but not limited to, "vertical," "horizontal," "lateral," "front," "rear," "side," "forward," "rearward," "upper," "lower," "above," "below," "right," "left," etc., may be used in reference to the orientation of the cutting head 12 as represented in FIGS. 2 and 7, and therefore are relative terms that are useful to describe the illustrated embodiment but should not be otherwise interpreted as limiting the scope of the invention.

FIG. 7 represents the knife assembly 60 mounted to and between the support rings 22 and 24 of the cutting head 12. It should be understood that the knife assembly 60 is illustrative of one of multiple identical knife assemblies that would be circumferentially mounted to the cutting head 12. Similar to the knife assemblies previously described in reference to FIGS. 2 through 6, the knife assembly 60 comprises a knife 62 secured to and between a knife holder 64 and clamp 66. The knife 62 is depicted as having a straight cutting edge 72 for producing flat slices, though knives of other shapes can be used to produce sliced, strip-cut, shredded and granulated products. A nonlimiting example is a knife having a cutting edge that defines a periodic pattern of peaks and valleys when viewed edgewise. The knife holder 64 is represented as secured to the support rings 22 and 24 with bolts 58, such that the holder 64 is able to serve as a support for the knife assembly 60 and mount other components of the assembly 60 to the support rings 22 and 24. However, it is also foreseeable that the knife assembly 60 may be mounted to the support rings 22 and 24 with a shoe, as shown in FIG. 2. In either case, the knife holder 64 and clamp 66 are located radially inward and outward, respectively, relative to each other on the cutting head 12.

Figure 8:
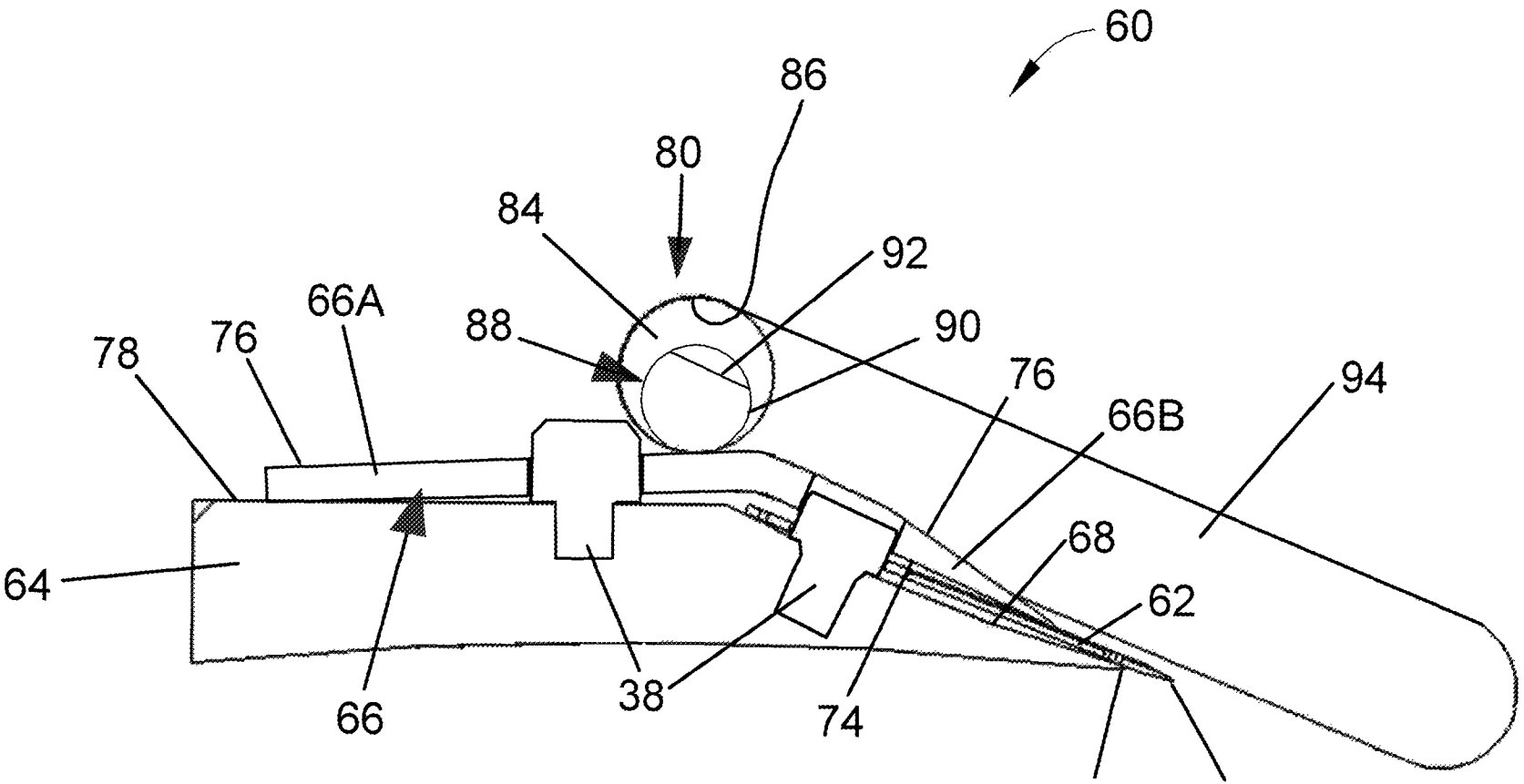
FIG. 8 is a cross-sectional isolated view of the knife assembly of FIG. 7.
Figure 9:
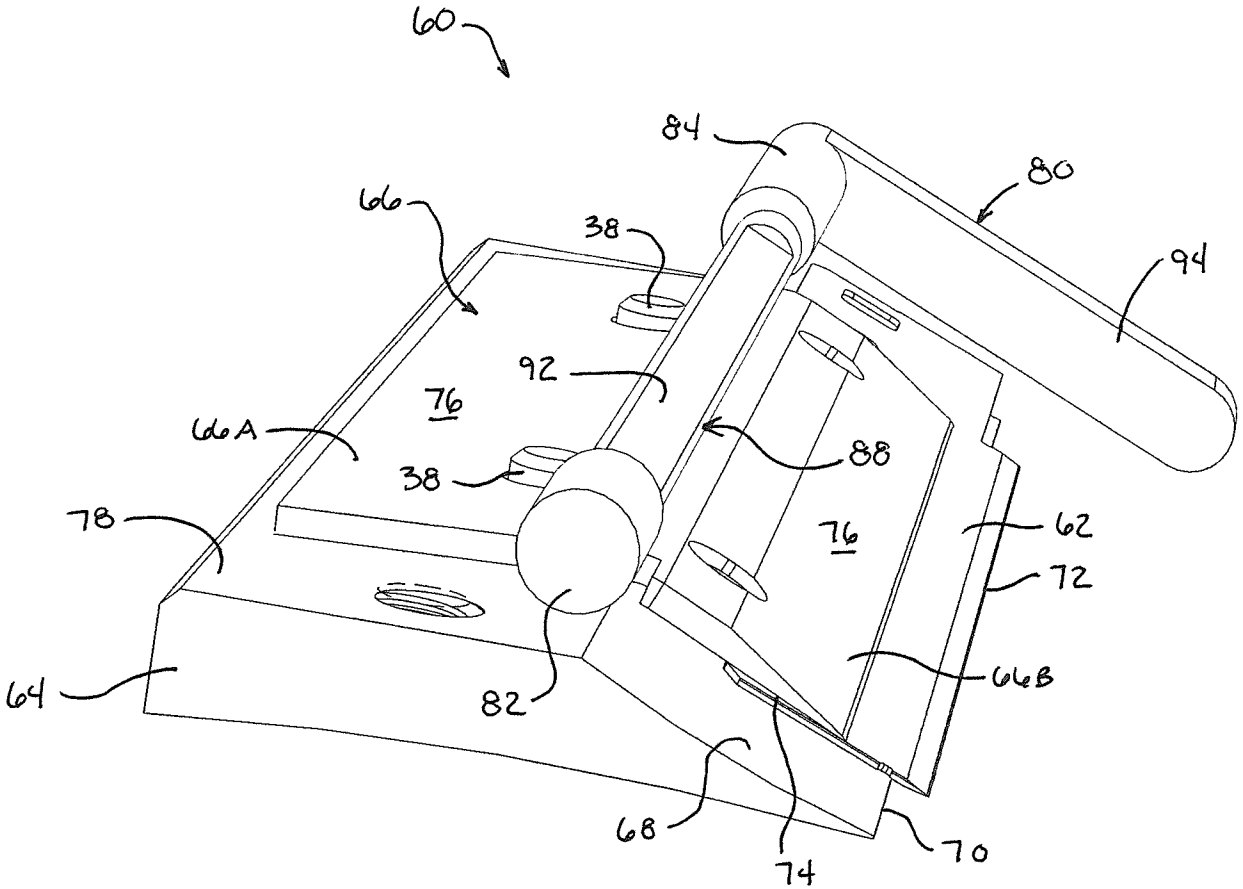
FIGS. 9 and 10 are perspective isolated views of the knife assembly of FIGS. 7 and 8, showing clamping and release positions, respectively, of the knife assembly.
Figure 10:
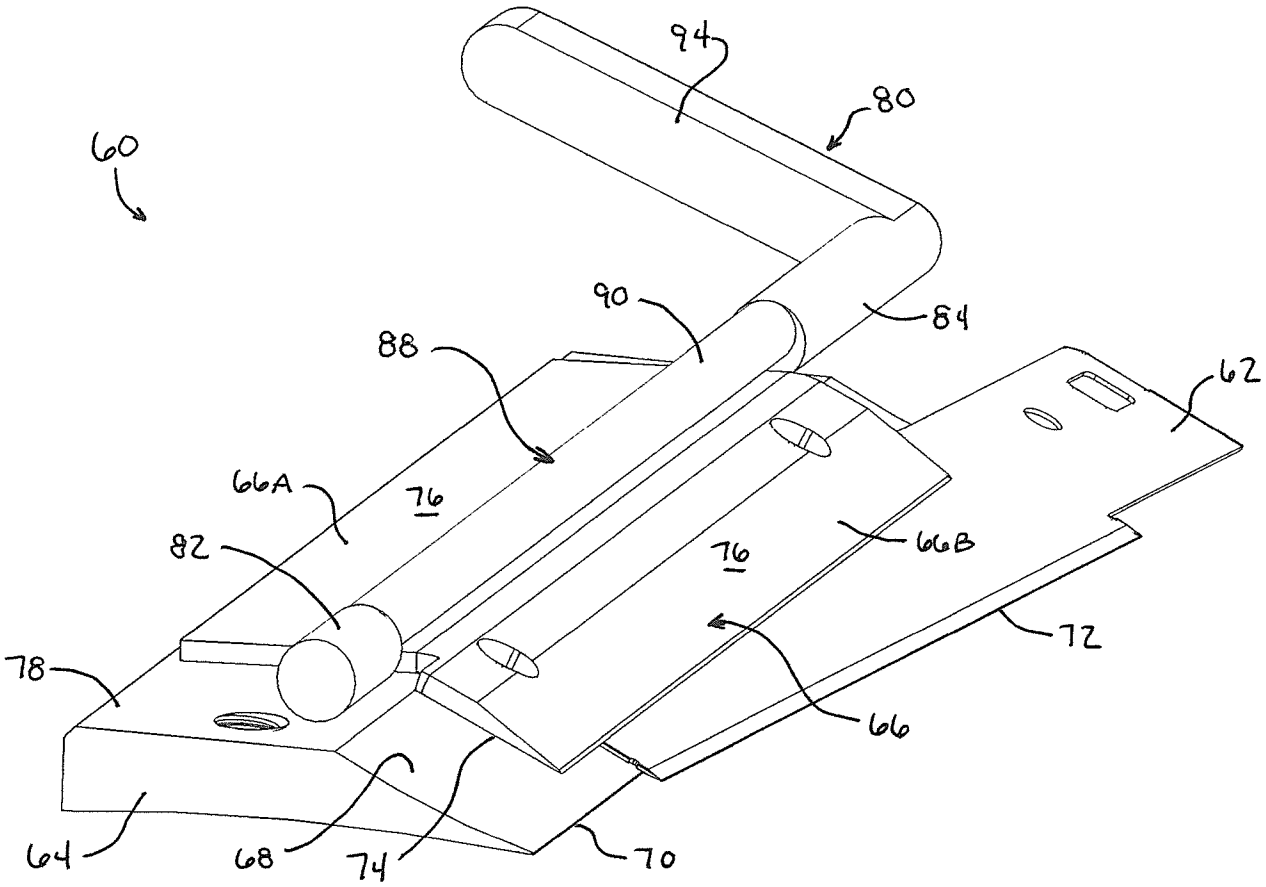

As more readily apparent from FIGS. 8 through 10, the knife holder 64 has a knife support surface 68 that terminates at a distal edge 70. The knife 62 is supported by the knife support surface 68 so that its cutting edge 72 projects beyond the distal edge 70. The clamp 66 overlies the knife holder 64 so that the knife 62 is between the knife support surface 68 of the knife holder 64 and an inward surface 74 of the clamp 66 faces the knife holder 64. The clamp 66 further has an outward surface 76 that faces away from the knife holder 64. Alignment of the knife 62 and clamp 66 is achieved with pins 38 that protrude from the knife holder 64. In the nonlimiting embodiment shown, two pins 38 protrude from a clamp support surface 78 of the knife holder 64 and pass through a portion 66A of the clamp 66, and two pins 38 protrude from the knife support surface 68 of the knife holder 64, pass through the knife 62, and extend into but not through a second portion 66B of the clamp 66. The knife and clamp support surfaces 68 and 78 of the knife holder 60 are not coplanar, and support the two clamp portions 66A and 66B of the clamp 66, which are also not coplanar.

The knife 62 is clamped between the knife holder 64 and clamp 66 through the action of a clamping rod 80. In the illustrated embodiment, the clamping rod 80 is rotatably mounted to the cutting head 12 as a result of its opposite lower and upper ends 82 and 84 being received in holes 86 formed in the support rings 22 and 24 (FIG. 7). The ends 82 and 84 of the clamping rod 80 are preferably coaxial, whereas between its ends 82 and 84 the clamping rod 80 has a camming portion 88 that is eccentric to the ends 82 and 84 and holes 86, in other words, the axis of the camming portion 88 is parallel but not coaxial with the ends 82 and 84 the clamping rod 80. The rod 80 is able to rotate within the holes 86 between two positions, referred to herein as clamping and release positions, as discussed below. A handle 94 is provided at the upper end 84 of the rod 80 to facilitate its rotation by hand.

The camming portion 88 of the rod 80 comprises an arcuate camming surface 90 adapted to contact the outward surface 76 of the clamp portion 66A of the clamp 66 and force the clamp 66 toward the knife holder 64 when the clamping rod 80 is rotated to its clamping position, which is depicted in FIGS. 7, 8 and 9. In the clamping position, the camming portion 88 and its camming surface 90 are at their closest proximity to the knife holder 64 due to the eccentricity of the camming portion 88, with the result that the camming surface 90 applies an increasingly greater force to the clamp portion 66A of the clamp 66 as the camming portion 88 is rotated in the clamping direction (clockwise in FIG. 8). The camming portion 88 is located near the junction between the non-coplanar clamp portions 66A and 66B of the clamp 66, and slightly closer to the end of the clamp portion 66B contacting the knife 62 than to the end of the clamp portion 66A contacting the knife holder 64, with the result that the clamp 66 is forced against the surface 78 of the knife holder 64 that is overlaid by the clamp portion 66A and also forced against the surface 68 of the knife holder 64 that is overlaid by the clamp portion 66B. In so doing, the knife 62 is clamped between the knife holder 64 and clamp 66.

The nonlimiting embodiment of the camming portion 88 shown in the drawings further comprises a planar surface 92, represented as lying on a chord of the otherwise circular cross-sectional outline defined by the camming portion 88. As a result, the camming surface 90 has a cross-sectional shape of a major segment of a circle, in other words, the fragment of a circle bounded by the chord defined by the planar surface 92 and the major arc defined by that chord. As seen in FIGS. 8 and 9, the camming surface 90 faces the clamp 66 and the planar surface 92 faces away from the clamp 66 when the camming portion 88 is in the clamping position. The planar surface 92 is preferably present on the camming portion 88 to provide greater clearance for slices that travel over the knife 62 and the outward surface 76 of the clamp 66 as they exit the cutting head 12.

Rotating the camming portion 88 of the rod 80 to its release position (counterclockwise in FIG. 8) as depicted in FIG. 10, results in the camming portion 88 and its camming surface 90 being rotated out of engagement with the clamp 66 to release the force that had been applied by the rod 80 against the clamp 66. In the release position, which is represented in the drawings as the result of rotating the camming portion 88 about 180 degrees, the camming portion 88 is at its greatest distance from the knife holder 64 due to its eccentricity, and the majority of the camming surface 90 faces away from the clamp 66, with the result that the clamp portion 66A of the clamp 66 is freed and can be raised off the surfaces 68 and 78 of the knife holder 64 as illustrated in FIG. 10. Because the knife 62 is no longer clamped between the knife holder 64 and clamp 66, the knife 62 can be removed from the knife assembly 60 as indicated in FIG. 10. In the illustrated embodiment, the planar surface 92 faces the clamp 66 in the release position, which may provide additional clearance for movement of the clamp 66 and removal of the knife 62.

From the above, it can be appreciated that the knife 20 can be quickly secured and released by rotating the rod 80 between its clamping and release positions. In contrast to the knife assembly 40 of FIGS. 5 and 6, the clamping rod 80 is not situated between the knife holder 64 and clamp 66 and does not rely on a component (e.g., the clamping bar 46) to serve as a fulcrum to apply a clamping load to the clamp 66. Instead, the clamp 66 is between the knife holder 64 and clamping rod 80, and the clamping rod 80 is eccentrically mounted to the support rings 22 and 24 and uses this eccentricity to apply a clamping load to the clamp 66.

While the invention has been described in terms of a specific or particular embodiment, it should be apparent that alternatives could be adopted by one skilled in the art. For example, the machine 10, cutting head 12, impeller 14, knife assembly 60, and their respective components could differ in appearance and construction from the embodiment described herein and shown in the drawings, functions of certain components of the machine 10, cutting head 12, impeller 14, and/or knife assembly 60 could be performed by components of different construction but capable of a similar (though not necessarily equivalent) function, and various materials could be used in the fabrication of the machine 10, cutting head 12, impeller 14, knife assembly 60, and their respective components. In addition, the invention encompasses additional or alternative embodiments in which one or more features or aspects of the disclosed embodiment could be eliminated. Accordingly, it should be understood that the invention is not necessarily limited to any embodiment described herein or illustrated in the drawings. It should also be understood that the phraseology and terminology employed above are for the purpose of describing the illustrated embodiment, and do not necessarily serve as limitations to the scope of the invention. Therefore, the scope of the invention is to be limited only by the following claims.

The invention claimed is:

1. A slicing machine comprising a cutting head and a knife assembly mounted to the cutting head, the knife assembly comprising:

a knife holder having a clamp support surface and a knife support surface terminating at a distal edge;

a knife supported by the knife support surface of the knife holder, the knife having a cutting edge that projects beyond the distal edge of the knife holder;

a clamp overlying the knife holder so that the knife is between the knife support surface of the knife holder and the clamp, the clamp having an inward surface facing the knife holder and an outward surface facing away from the knife holder, the clamp having first and second clamp portions that are not coplanar and have a junction therebetween, the first clamp portion contacting the clamp support surface of the knife holder, the second clamp portion contacting the knife, and the junction being out of contact with the knife holder and the knife; and a clamping rod that secures the clamp to the knife holder and clamps the knife therebetween, the clamping rod having a camming surface that contacts the outward surface of the clamp near the junction between the first and second clamp portions, the clamping rod being rotatable to have a clamping position and a release position, the camming surface applying a force that clamps the clamp against the knife holder when the clamping rod is in the clamping position so that the first clamp portion is forced against the clamp support surface of the knife holder and the second clamp portion is forced against the knife, the camming surface releasing the force against the clamp when the clamping rod is in the release position.

2. The slicing machine according to claim 1, wherein the clamp is between the knife holder and the clamping rod, and the clamping rod is eccentrically mounted to the cutting head and uses eccentricity to apply a clamping load to the clamp when rotating from the release position to the clamping position.

3. The slicing machine according to claim 1, wherein the camming surface of the clamping rod comprises a cylindrical portion of the clamping rod that faces and contacts the clamp in the clamping position and faces away from and disengages the clamp in the release position.

4. The slicing machine according to claim 3, wherein the clamping rod further comprises a planar portion that faces away from the clamp in the clamping position.

5. The slicing machine according to claim 4, wherein the planar portion faces the clamp in the release position.

6. The slicing machine according to claim 1, wherein the clamping rod is rotatably and eccentrically mounted in the slicing machine, the clamping rod is closer to the knife holder in the clamping position, and the clamping rod is farther from the knife holder in the release position.

7. The slicing machine according to claim 1, wherein the cutting head comprises support members and the knife assembly is mounted to and between the support members.

8. The slicing machine according to claim 7, wherein the knife holder supports and mounts the clamp and the knife to the support members.

9. The slicing machine according to claim 7, wherein the clamping rod has first and second ends rotatably coupled to the support members so that the camming surface of the clamping rod is eccentric to the first and second ends of the clamping rod, the clamping rod is closer to the knife holder in the clamping position, and the clamping rod is farther from the knife holder in the release position.

10. The slicing machine according to claim 1, wherein the cutting head is an annular-shaped cutting head, the slicing machine further comprises an impeller coaxially mounted within the cutting head for rotation about an axis of the cutting head in a rotational direction relative to the cutting head, the impeller has means for delivering food products radially outward toward the cutting head, and the knife extends radially inward toward the impeller in a direction opposite the rotational direction of the impeller.

11. A method of clamping a knife of a knife assembly in a slicing machine that comprises a cutting head to which the knife assembly is mounted, the knife assembly comprising a knife holder having a clamp support surface and a knife support surface that supports the knife and a clamp overlying the knife holder so that the knife is between the knife support surface of the knife holder and the clamp, the clamp having first and second clamp portions that are not coplanar and have a junction therebetween, the first clamp portion contacting the clamp support surface of the knife holder, the second clamp portion contacting the knife, and the junction being out of contact with the knife holder and the knife, the method comprising:

rotating a clamping rod from a release position to a clamping position to secure the clamp to the knife holder and clamp the knife therebetween, the clamping rod being eccentrically mounted to the cutting head and using eccentricity to apply a clamping load to the clamp when rotated from the release position to the clamping position, the clamping rod having a camming surface that contacts the clamp near the junction between the first and second clamp portions with the result that the first clamp portion is forced against the clamp support surface of the knife holder and the second clamp portion is forced against the knife.

12. The method according to claim 11, wherein the clamping rod is rotatably and eccentrically mounted in the slicing machine so that the clamping rod is closer to the knife holder in the clamping position and farther from the knife holder in the release position.

* * * * *